US006336694B1

(12) United States Patent
Ishizaka

(10) Patent No.: US 6,336,694 B1
(45) Date of Patent: Jan. 8, 2002

(54) NAIL ART METHOD AND DEVICE

(75) Inventor: Masato Ishizaka, Yamanashi-ken (JP)

(73) Assignee: Jit Ceremony Co., Ltd., Yamanashi-ken (JP)

( * ) Notice: Subject to any disclaimer, the term of this patent is extended or adjusted under 35 U.S.C. 154(b) by 0 days.

(21) Appl. No.: 09/462,411

(22) PCT Filed: Dec. 8, 1998

(86) PCT No.: PCT/JP98/05538

§ 371 Date: Jan. 10, 2000

§ 102(e) Date: Jan. 10, 2000

(87) PCT Pub. No.: WO99/33372

PCT Pub. Date: Jul. 8, 1999

(30) Foreign Application Priority Data

Dec. 24, 1997 (JP) ..... 9-353965

(51) Int. Cl.[7] ..... B41J 3/00; B41J 2/01

(52) U.S. Cl. ..... 347/2; 347/105

(58) Field of Search ..... 347/2, 104, 105; 346/139 D

(56) References Cited

U.S. PATENT DOCUMENTS

| | | | | |
|---|---|---|---|---|
| 5,309,365 A | | 5/1994 | Sullivan et al. | |
| 5,931,166 A | * | 8/1999 | Weber et al. | 132/73 |
| 6,067,996 A | * | 5/2000 | Weber et al. | 132/73 |

FOREIGN PATENT DOCUMENTS

| | | |
|---|---|---|
| JP | 5293955 | 11/1993 |
| JP | 5-293955 A | 11/1993 |
| JP | 670810 | 3/1994 |
| JP | 6155729 | 3/1994 |
| JP | 6-155729 A | 6/1994 |
| JP | 7299902 | 11/1995 |
| JP | 7-299902 A | 11/1995 |

* cited by examiner

*Primary Examiner*—Thinh Nguyen

(57) ABSTRACT

According to the present invention, a method and an apparatus therefor are provided that enable to automatically print a desired nail art picture on one's own fingernail surface. The method of the present invention comprises the steps of: holding a nail surface (2) on a finger holder (9); selecting one or more nail art pictures from nail art pictures stored in a computer (4), as a printing pattern; moving either one or both of a nozzle unit (1) and the finger holder (9) by controlling of the computer (4); and printing the selected printing pattern on the nail surface (2) by having ink jetted ink from the nozzle unit (1) by controlling of the computer (4). The apparatus of the present invention comprises: a computer (4); a finger holder (9); a nozzle unit (1) controlled by the computer (4); and moving device (3) for moving either one or both of the nozzle unit (1) and the finger holder (9) controlled by the computer (4). It may be arranged that the computer (4) has a display (22) and data input device, such as a video movie camera (28), connected thereto, to input and display printing patterns and printing masks for limiting the printing areas of the printing patterns, edit either one or both of printing patterns and printing masks on the screen (23) of the display (22), display printing patterns with printing masks put thereon, on the nail surface of a nail image, and select and store a printing pattern with a printing mask(s) put thereon.

20 Claims, 11 Drawing Sheets

NAIL ART METHOD AND DEVICE

This application is the national phase under 35 U.S.C. §371 of PCT International Application No. PCT/JP98/05538 which has an International filing date of Dec. 8, 1998, which designated the United States of America.

TECHNICAL FIELD

The present invention relates to a method of, and an apparatus for, providing nail art by automatically drawing an object, such as a picture, on a nail surface.

BACKGROUND TECHNOLOGY

Hitherto, the nail art has been a kind of art where an expert draws a nail art object, such as a picture, on a human nail surface, using manicure. It has been difficult for an amateur who is not a skilled expert, to draw a desired object, such as a picture, on a nail surface, using manicure. Even to a skilled person, it has been not easy to draw a nail art object, such as a nail art picture, on the nail of his/her right hand fingers in case of right-handed, or on the nail of his/her left hand fingers in case of left-handed.

A method and apparatus are described in Japanese Patent Unexamined Publication (Kokai) H6-70810 (1994), where an object, such as a nail art picture, is printed on the surface of a thin sheet that is adherable to a human fingernail surface or the nail surface of an artificial nail, instead of drawing such nail art picture, directly on a human fingernail surface, and the printed sheet is then cut to a 2-D shape fit to the nail surface.

However, there has been need for printing a nail art picture directly on a human fingernail surface or the nail surface of an artificial nail, instead of adhering a piece of sheet with a nail art picture printed thereon, to a human fingernail surface or the nail surface of an artificial nail.

DISCLOSURE OF THE INVENTION

An object of the present invention is to provide a method and an apparatus therefor that enable to print a nail art work, such as a desired nail art picture on one's own fingernail surface by him/herself. These method and apparatus are also applicable to the nail surface of an artificial nail, as they are.

To attain the object, a method according to the present invention is provided comprising the steps of holding at least one nail surface on a finger holder; selecting one ore more printing patterns from printing patterns stored in control means; moving either one or both of printing means and the finger holder by means of moving means controlled by the control means; and, concurrently, printing the selected printing pattern on the one or more nail surfaces.

To apply this method, an apparatus according to the present invention is provided comprising control means, a finger holder, printing means under the control of the control means for printing a nail art picture on a nail surface held by the finger holder, and moving means under the control of the control means for moving either one or both of the printing means and the finger holder. The nail surface, which a printing pattern is printed on, is a human fingernail surface or the nail surface of an artificial nail.

As the control means, a computer may be used equipped with a CPU, an internal memory, interfaces, an external memory, and a keyboard. As the printing means, a nozzle unit of an ink jet printer may be used. The control means moves the finger holder and the nozzle unit relative to each other so that a selected printing pattern is printed on the nail surface. The nozzle unit moving mechanism of an ink jet printer may be used as a part of the moving means.

The nozzle unit may employ the nozzle unit of a color ink jet printer, equipped with four or more ink jet nozzles, of colors including the three primary colors and black, as it is. The nozzle unit jets color ink from the ink jet nozzles under the control of the computer.

It may be arranged that the control means stores various nail art pictures beforehand, the stored nail art pictures are printed on a sheet of paper beforehand, from which a desired nail art picture is enabled to select by key operations.

When the moving means moves the nozzle unit only, the finger holder holds the nail surface which the nail art work is applied to, in a predetermined position. The moving means, controlled based on a program stored in the control means, moves the nozzle unit from a starting position to a terminating position along a predetermined moving route. The control means jets color ink from the ink jet nozzles in a position on the moving route where the nail art picture is printed, based on a program, for printing the nail art picture, stored in the control means.

The control means may be connected to display means to display printing patterns on the screen of the display for selecting a printing pattern from the displayed printing patterns.

The control means may be connected to data input means, such as a video movie camera, an image scanner, and a digital still camera. Thereby, data, such as printing patterns, printing masks for limiting the printing areas of the printing patterns, and a nail surface image, may be inputted to the control means, where such data may be displayed on the screen of the display means, and edited separately or in combination, for the edited data to be selected and stored for printing.

Preferably, the control means may have the capability to extract only the nail contour from the nail image, and thereby form, edit, and store printing masks with either the inside or outside of the nail contour selectively defined as either printing or trimming areas of the printing masks; the capability to combine a plurality of printing masks; the capability to select, edit and store printing masks while referring, on the screen, the nail image to at least one printing mask stored beforehand; the capability to display, edit, on the screen, and store combined images formed by combining printing patterns onto printing masks; the capability to select, on the screen, printing patterns to be printed; the capability to display, edit, on the screen, and store combined images formed by combining printing patterns with other printing patterns; and the capability to edit and store images picked up by the data input means, as printing patterns.

Furthermore, the control means, image pickup means, display means, and printing means may be enabled to deal with a plurality of nail surface simultaneously. The control means may be equipped with a data correcting function for printing the printing patterns on a plurality of nail surfaces.

The ink jet printer or jetting means, such as a spray, other than the ink jet printer may be preferably arranged to jet either one or both of a preprinting processing solution for forming a layer allowing ink dispersion, on the nail surface, and a postprinting processing solution for forming a layer protecting the print, on the nail surface.

As described above, by applying the nail art method of the present invention by means of the nail art apparatus of the present invention, an excellent effect is exhibited that a user is enabled to print a desired nail art picture on his/her own fingernail surface or the nail surface of an artificial nail, by him/her-self.

The apparatus of the present invention equipped with image pickup means, display means, control means, and printing means, exhibits an excellent effect that a user is enabled to input, form, edit, and store, on the spot, an object to be drawn on the nail surface, such as a picture, and print the object, such as a picture, on his/her nail surface, accurately.

BEST EMBODIMENTS OF THE INVENTION

Figure 1:
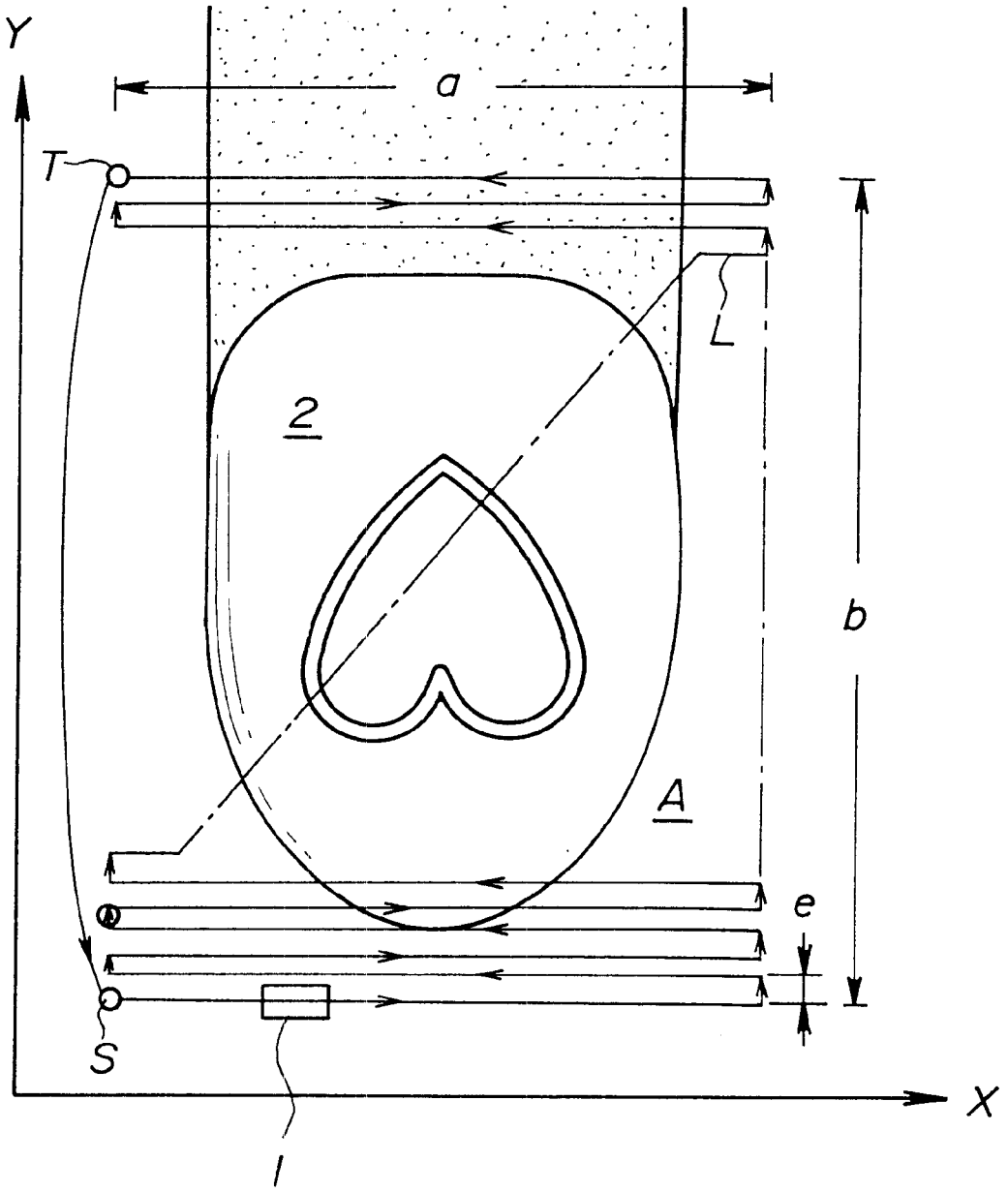
FIG. 1 is a block diagram showing the movement of a nozzle unit relative to a nail surface, according to the present invention.

Hereunder, a first embodiment of the method and apparatus of the present invention is described, referring to the drawings attached hereto. FIG. 1 shows a moving route of a nozzle unit 1, relative to a nail surface 2. The nozzle unit 1 moves from a starting point S in the direction X rightward by a distance "a," then in the direction Y upward by a distance "e," next, in the direction X backward by a distance "a," then in the direction Y upward by a distance "e." These back and forth movements in the direction X and upward or forward movements in the direction Y are repeated, whereby the nozzle unit 1 moves along a predetermined moving route L until it reaches a terminating point T located in a position apart from the starting point S by a distance "b" in the direction Y. After reaching the terminating point T, the nozzle unit 1 returns to the starting point S in a straight line. One unit moving distance "e" in the direction Y is equal to the pitch in the direction Y of pixels formed on the nail surface by jetting color ink from a nozzle by means of a computer. The moving route L successively passes through all points corresponding to all pixels within a rectangular moving area A having a width "a" in the direction X and a width "b" in the direction Y. The width "a" in the direction X is greater than the lateral width of the nail surface 2 which nail art is applied to, and the width "b" in the direction Y is greater than the longitudinal width of the nail surface 2. When the nail surface 2 is held in a predetermined position, the nail surface 2 falls within the moving area A, and the longitudinal centerline of the nail surface 2 coincides with the longitudinal centerline of the moving area A.

Figure 2:
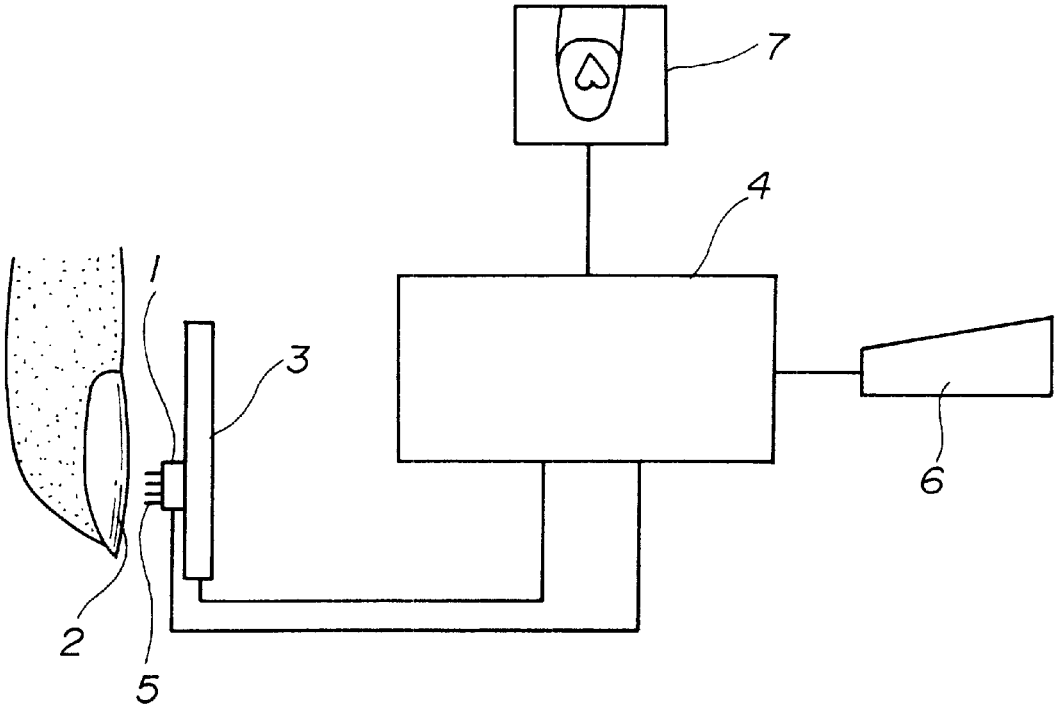
FIG. 2 is a block diagram showing the control in a first embodiment of the apparatus of the present invention.

As shown in FIG. 2, in case only the nozzle unit 1 is moved, then, when the nail surface 2 is held in a predetermined position, a plurality of nozzles 5 of the nozzle unit 1 are positioned opposite to the nail surface 2. A keyboard is operated to cause a computer 4 to execute a program for selecting one nail art picture from various nail art pictures stored in the computer 4 beforehand, and printing that nail art picture. When the program is executed, a moving means 3 for the nozzle unit 1 moves the nozzle unit 1 along the moving route L shown in FIG. 1, based on a control signal from the computer 4. When the nozzle unit reaches a point on the moving route L corresponding to a pixel constituting the selected nail art picture, the computer 4 outputs a control signal to the nozzle unit 1 for causing to jet ink from an ink jet nozzle 5 of the color of that pixel. Based on the control signal from the computer 4, the nozzle unit 1 jets ink from a nozzle 5 of the color specified, onto the nail surface 2. When the nozzle unit 1 has moved from the starting point S to the terminating point T along the moving route L shown in FIG. 1, the printing of the nail art picture 7 selected for the nail surface 2 has been completed.

As described above, application of a desired nail art picture to a user's own nail surface is enabled, only by holding the nail surface of his/her own finger in a predetermined position corresponding to the moving area of the nozzle unit moved by means of the computer, and by inputting instructions to the computer to select and print the desired one of nail art pictures stored in the computer.

Although not shown, the finger may be placed on the finger holder moved by the computer, to move the nail surface in the direction Y of FIG. 1, where the nozzle unit is moved by the compute in the direction X of FIG. 1, to apply a nail art picture. Furthermore, the nozzle unit may be held stationary, where only the finger holder is moved both in the directions X and Y, to apply a nail art picture.

Figure 3:
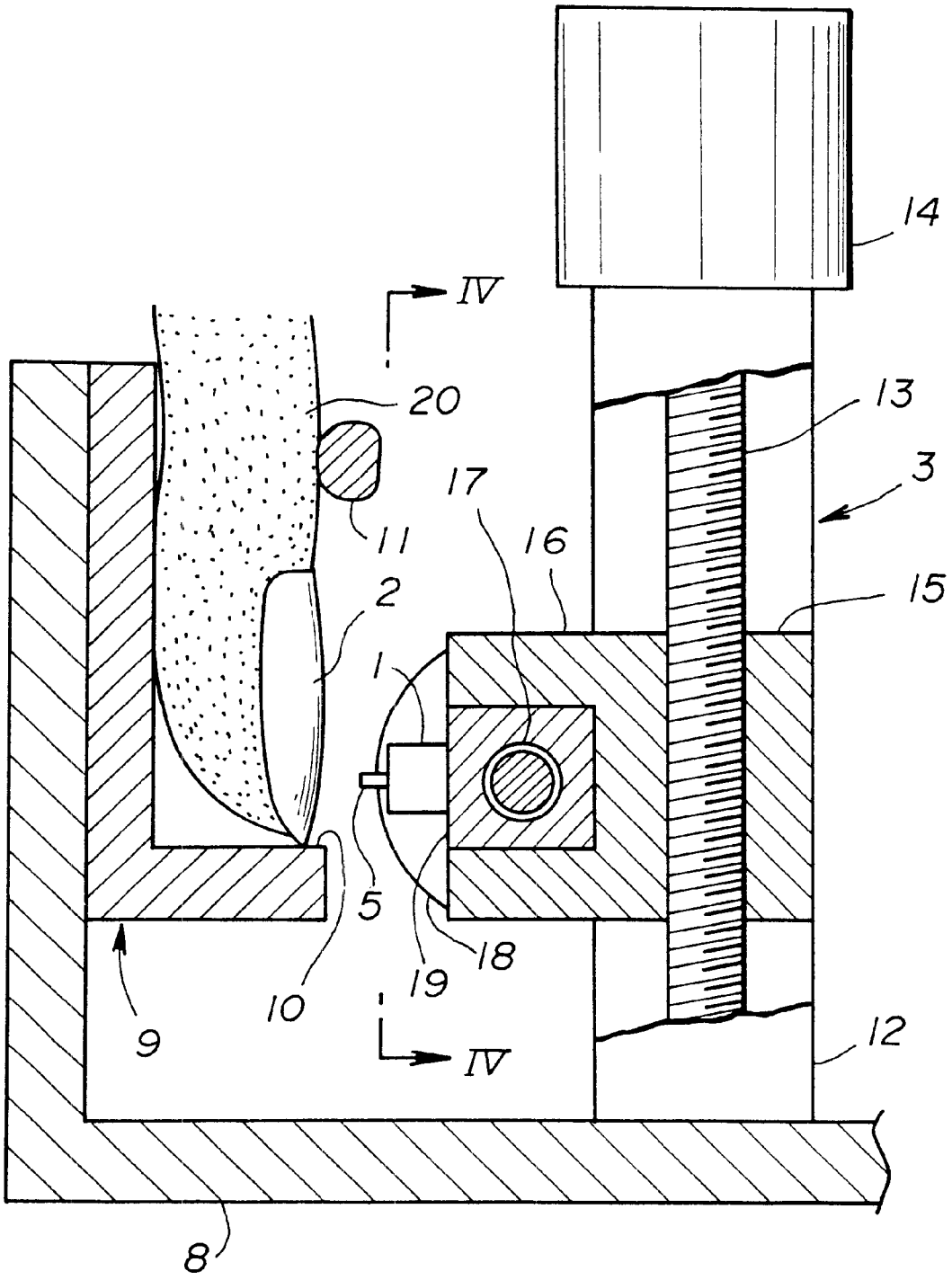
FIG. 3 is a side view partly in section of the moving means shown in FIG. 1.
Figure 4:
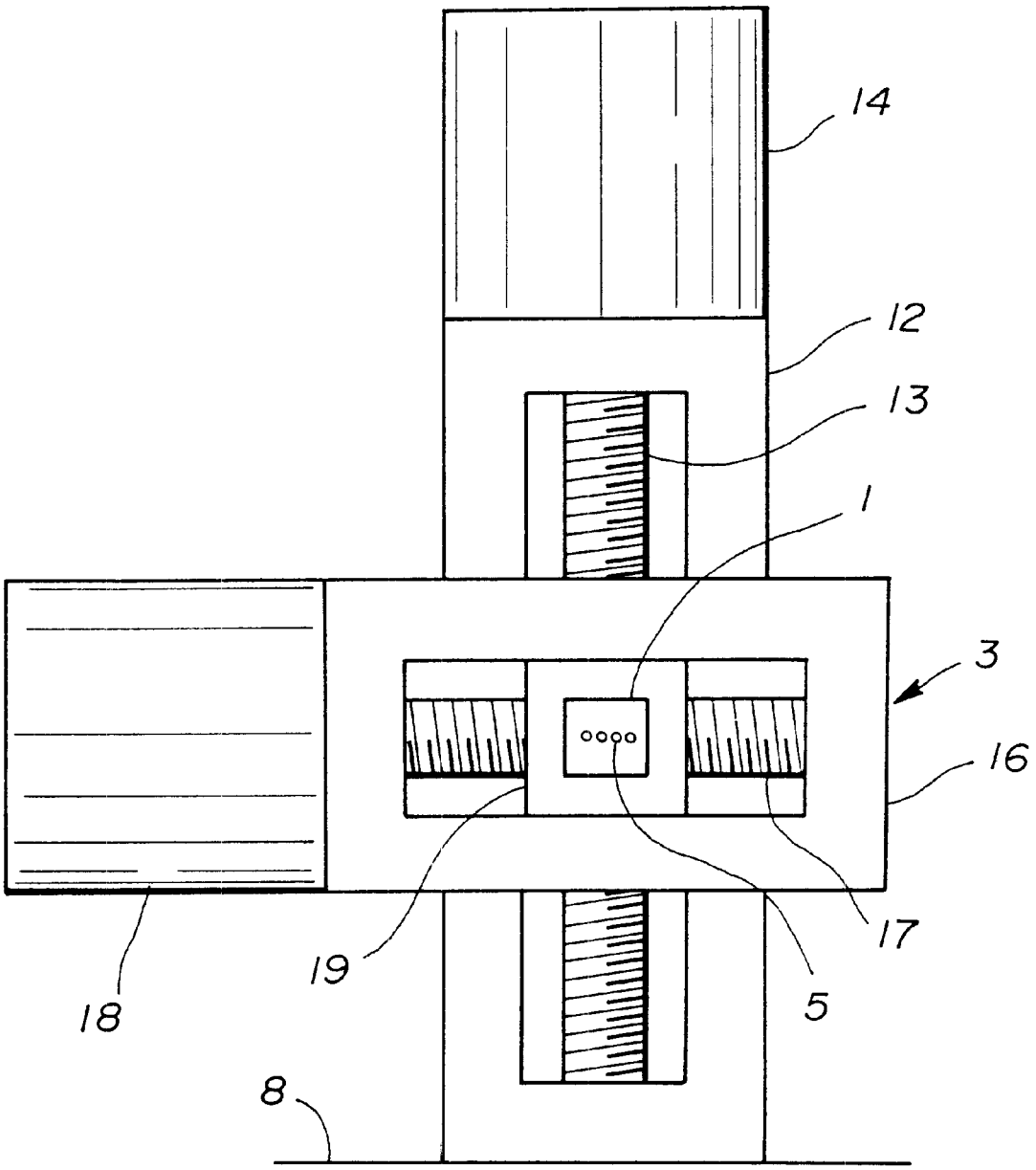
FIG. 4 is an inward side view along arrow lines IV—IV of FIG. 3.

As shown in FIGS. 3 and 4, a finger holder 9 is fixed to a frame 8. The finger holder has a fingernail tip stopper 10 for defining the position of a fingernail tip, and a finger back stopper 11 for butting a finger back against it. When placing a finger 20 on the finger holder 9, butting the fingernail tip against the fingernail tip stopper 10, and butting the back of the finer against the finger back stopper 11, then, the nail surface 2 is held in a predetermined position. The finger holders may be made ready in many variations to fit various sizes of fingers, to enable to replace as required. A stationary frame 12 of a moving means 3 is fixed to the frame 8. A longitudinal screw shaft 13 is supported by the stationary frame 12, where the longitudinal screw shaft 13 is directly coupled to a pulse motor 14. A longitudinal slider 15 is in screw engagement with the longitudinal screw shaft 13. A lateral frame 16 is formed in one body with the longitudinal slider 15, where a lateral screw shaft 17 is supported by the lateral frame. The lateral screw shaft 17 is directly coupled to a pulse motor 18. A lateral slider 19 is in screw engagement with the lateral screw shaft 17, where a nozzle unit 1 is fixed to the lateral slider 19.

The nozzle unit 1 is equipped with a plurality of nozzles 5, where color ink is jetted from the nozzles 5 under the control of a computer. The nozzles 5 are opposite to the nail surface 2 held by the finger holder 9. The pulse motors 14 and 18 turn under the control of the computer. When the pulse motor 14 turns, the nozzle unit moves in the longitudinal direction. When the pulse motor 18 turns, the nozzle unit moves in the lateral direction. The moving distance of the nozzle unit by a one-pulse turning angle is a multiple of the longitudinal and lateral pitches of the printing pixels, respectively. The computer controls the turning of the pulse motors 14 and 18 so that the nozzle unit 1 moves along the moving route L shown in FIG. 1. The program for printing one of the nail art pictures stored in the computer controls the nozzle unit 1 so that the nozzles jet ink of colors required for forming the one nail art picture when the nozzle unit 1 comes to a position on the moving route required for printing the one nail art picture. Under this control of the computer, when the nozzle unit 1 moves from the starting point S to the terminating point T along the moving route L, the nozzle unit 1 jets ink of colors constituting pixels of a nail art picture from the nozzles thereof at all the positions where all the pixels of the nail art picture are to be printed, respectively. Therefore, when the nozzle unit 1 moves from the starting point S to the terminating point T, and returns to the starting point S, the printing of the nail art picture for the nail surface 2 has been completed.

Not shown as an embodiment, both the nozzle unit and the finger holder may be arranged to move. In this case, a moving means for the finger holder and a moving means for the nozzle unit, both computer-controllable, may be provided, where the finger holder is moved back and forth for one time in the direction Y, or the longitudinal direction of the finger, while the nozzle unit is moved back and forth repeatedly in the direction X, or the lateral direction of the finger. Furthermore, another combination may be arranged where he nozzle unit is stationary and only the finger holder is moved both in the directions X and Y by a computer-controllable moving means for the finger holder.

Figure 5:
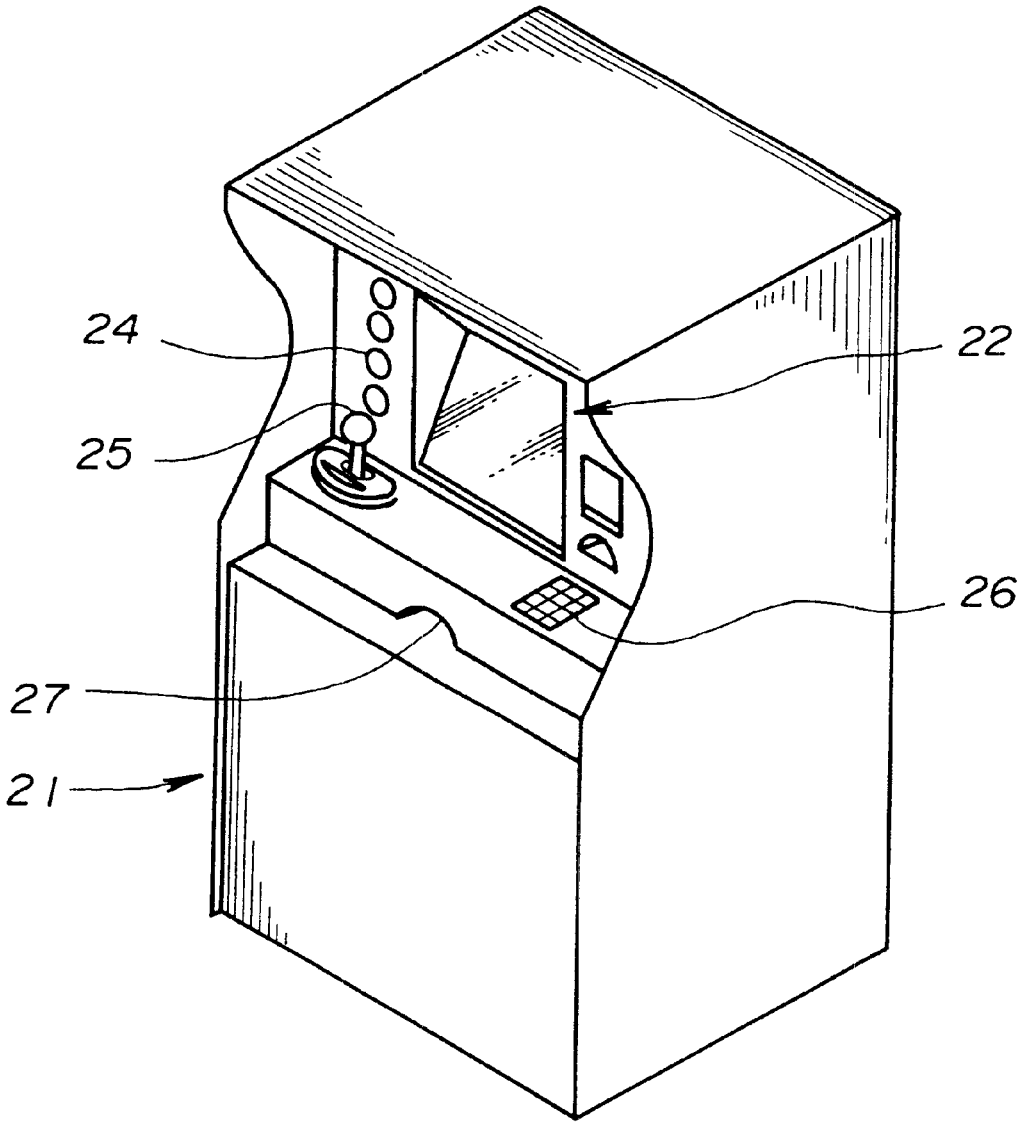
FIG. 5 is a perspective view showing outward appearances of a second embodiment.

As shown in FIG. 5, the apparatus according to a second embodiment is enclosed in a n enclosure 21, where a display 22, operating buttons 24, a joy stick 25, input keys 26, and an insertion opening 27 for inserting a finger to apply nail art to, are provided on the front side of the enclosure 21.

Figure 6:
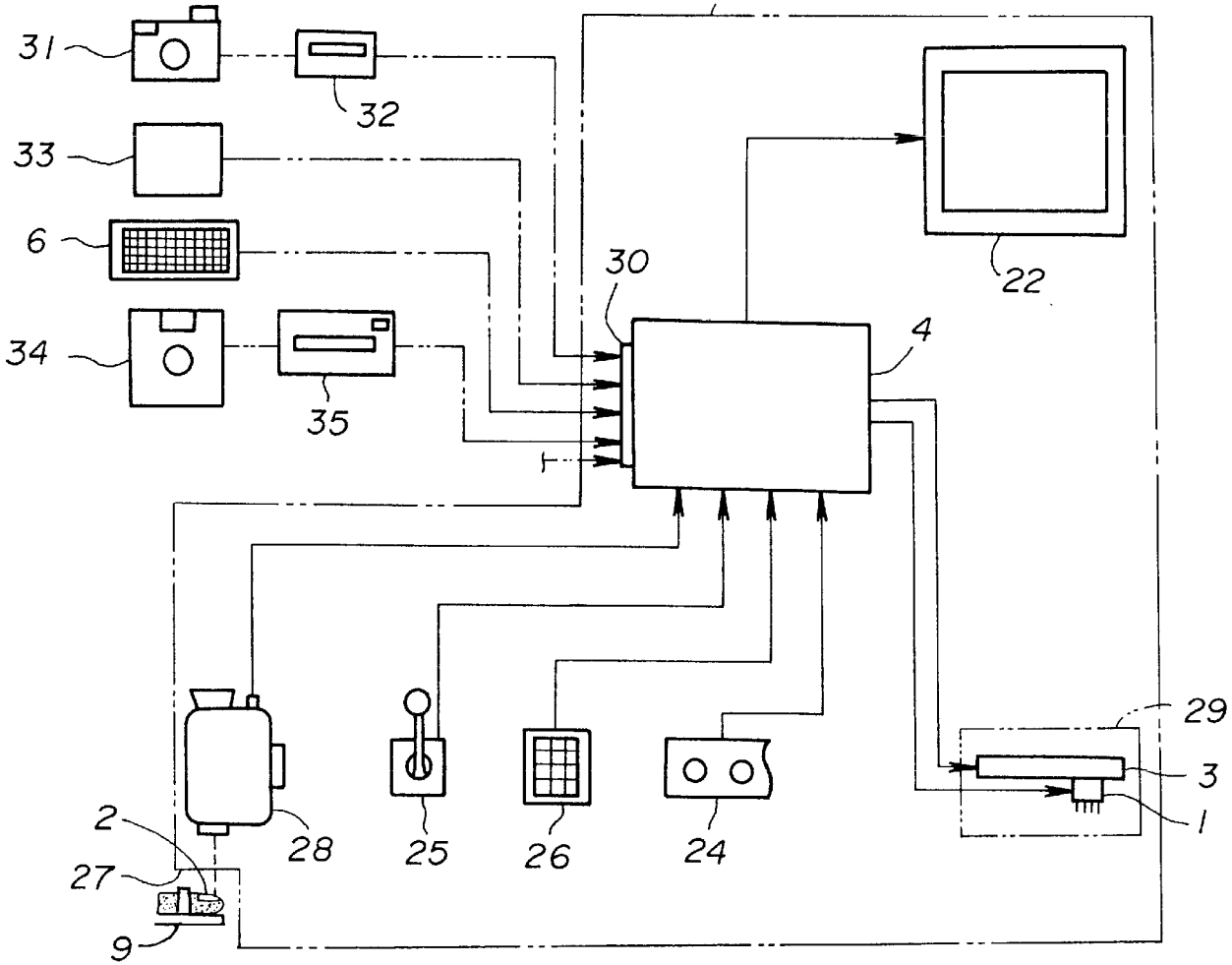
FIG. 6. is a block diagram showing the control in a second embodiment of the apparatus of the present invention.

As shown in FIG. 6, a computer 4 is provided in the enclosure 21, that has a memory required for conducting functions, such as image processing and printing control, where the display 22, operating buttons 24, a joy stick 25, and input keys 26, are connected to the computer 4, respectively. In addition, video movie camera 28 for picking up objects, such as the finger tip and printing patterns, a serial ink jet printer 29, and a moving means 3 for a nozzle unit 1, are connected to the computer 4, respectively. The nozzle unit 1 stores color ink having capability to print the printing patterns on a nail surface applied with the nail surface preprinting processing. The nozzle unit 1 also may be arranged to store and discharge a preprinting processing solution for forming a layer allowing ink dispersion, and a postprinting processing solution for forming a layer having water proofness and abrasion resistance. The preprinting processing solution is, for example, a hydrophilic resin solution with inorganic particles dispersed therein. The postprinting processing solution is, for example, a resin solution or emulsion.

The computer 4 has various interfaces for connecting external equipment. Various external equipment, such as a card reader 32 for a digital still camera 31, an image scanner 33, a keyboard 6, and a disk drive 34 for a floppy disk 35, may be connected to the interfaces 30, as required.

Inside the enclosure 21, a finger holder for holding in a predetermined position, and defining the position of, the fingertip of a hand inserted from the insertion opening 27, and a moving means 3 for moving the nozzle unit 1 of the printer 29 relative to the fingertip nail surface fixed to the finger holder, are provided. The finger holder and the moving means 3 used here are similar to the finger holder and the moving means 3 employed in the first embodiment.

Application of nail art in the second embodiment is proceeded in a manner described below.

Figure 7:
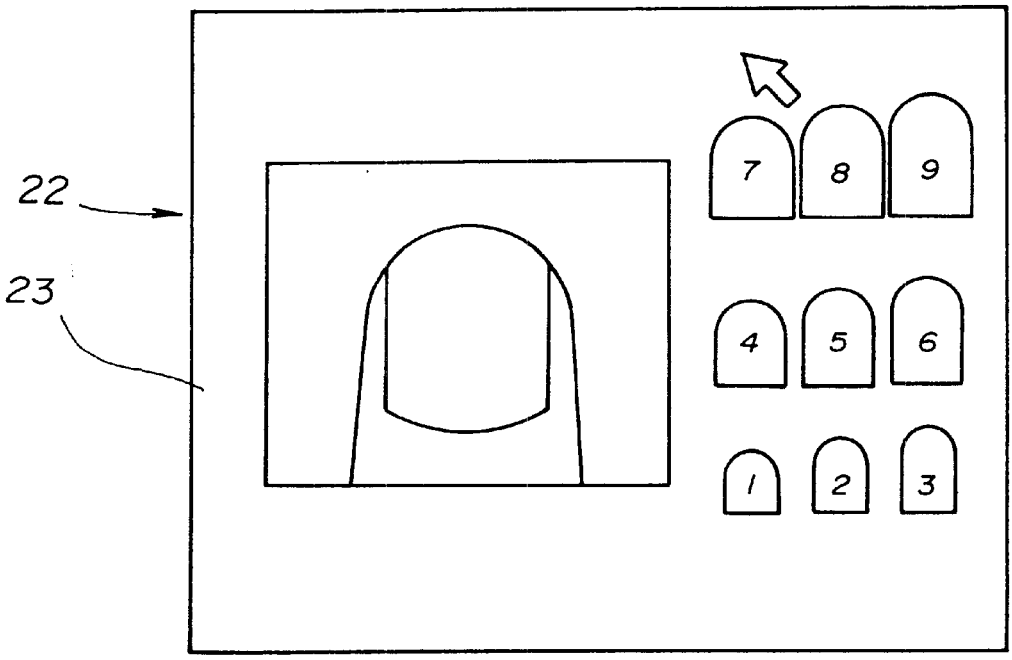
FIG. 7 is a schematic view showing the screen of a display exhibiting nail images.

A hand is inserted from the insertion opening 27 of the enclosure 21, with the fingertip of the hand then fixed to the finger holder, and the operating buttons are operated, whereby the computer 4 causes the video movie camera 28 to pick up the image of the fingertip nail surface, and displays this nail image and several different printing masks from many printing masks stored beforehand, on the screen 23 of the display 22, as shown in FIG. 7. These printing masks may be displayed in order of frequency or time of use. If required, the computer may be arranged to form a printing mask by extracting only the nail contour from a nail image. The input keys 26 shown in FIGS. 5 and 6 are operated to select a printing mask considered most suitable for the nail image, from the printing masks displayed.

Figure 8:
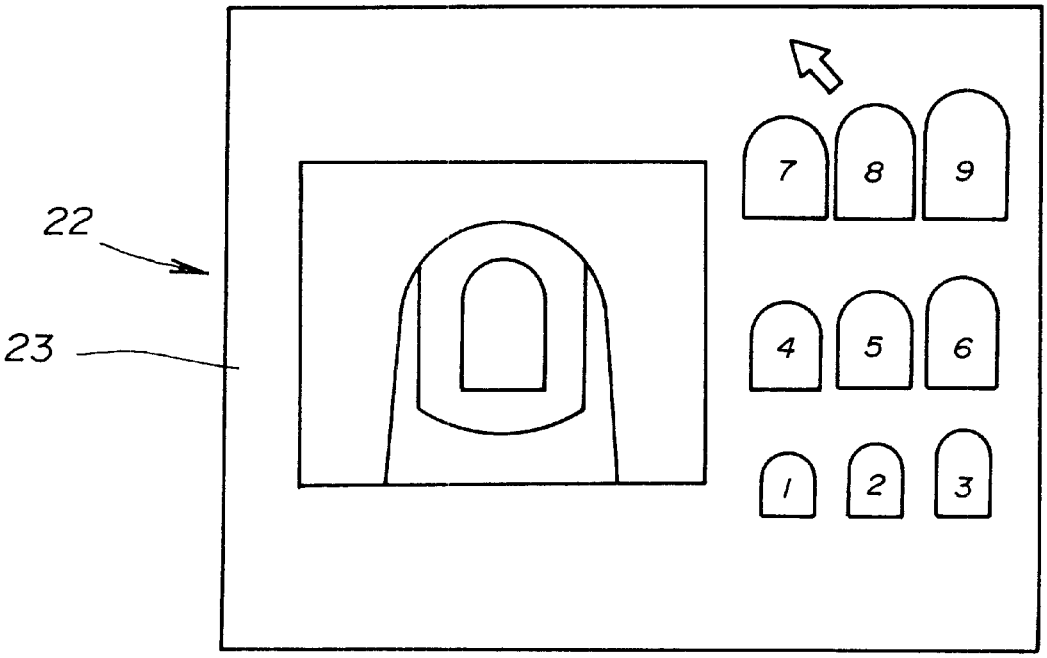
FIG. 8 is a schematic view showing the screen of a display exhibiting printing masks.

As shown in FIG. 8, the computer puts the selected printing mask on the nail image on the screen 23 of the display 22 in a predetermined position of the nail image, for example, a position where the center of the nail surface coincides with the center of the printing mask. In case the printing mask is not suitable, a printing mask considered more suitable is selected by operating the input keys.

Figure 9:
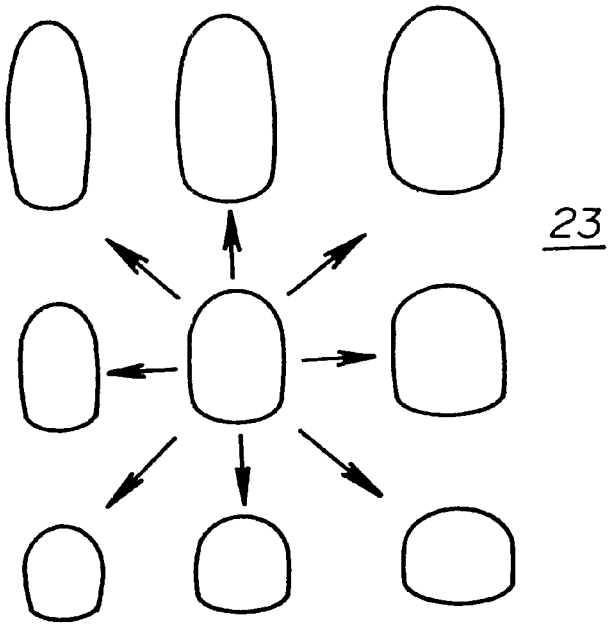
FIG. 9 is a schematic view showing the screen of a display exhibiting printing patterns.
Figure 10:
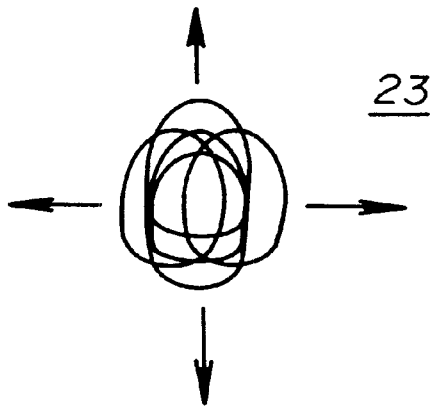
FIG. 10 is a schematic view showing the screen of a display exhibiting variations a printing mask.

As shown in FIG. 9, it may be arranged that several printing masks are designated as basic printing masks, and a basic printing mask selected is varied to numerous variations on the screen 23 by operating the joy stick 25 shown in FIGS. 5 and 6. Furthermore, as shown in FIG. 10, the position for putting the printing mask may be moved in numerous directions with the moving range finely adjusted, by using the joy stick 25. The printing mask may be finalized by operating the operating buttons 24 shown in FIGS. 5 and 6. These functions are all controlled by the computer.

Figure 11:
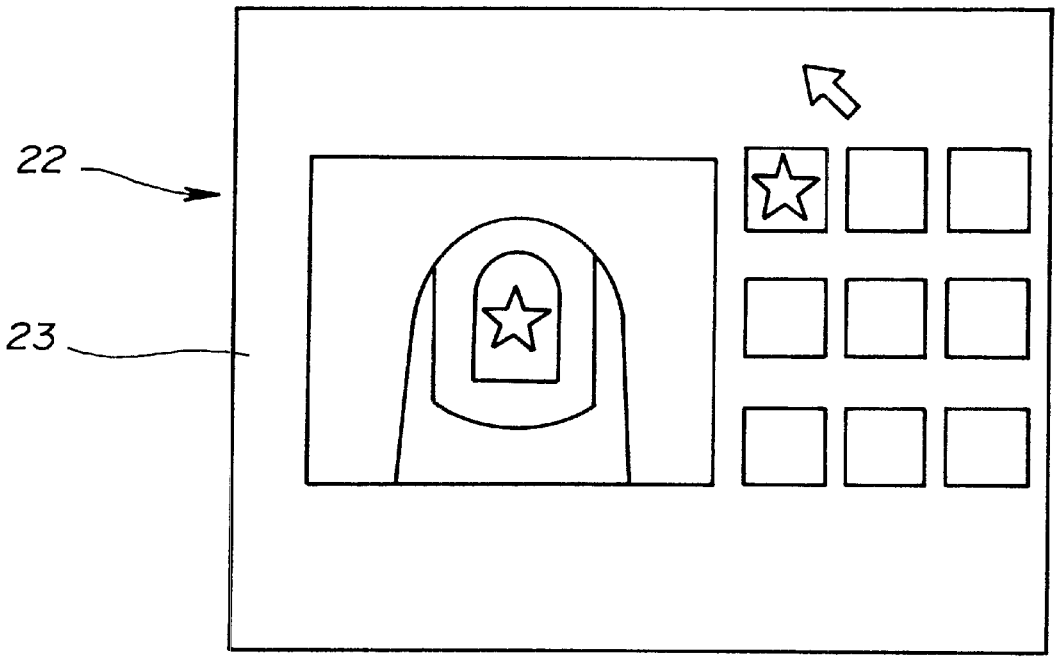
FIG. 11 is a schematic view showing the screen of a display exhibiting printing patterns obtained by putting a printing mask on a nail surface.

As shown in FIG. 11, the computer may display a nail image with a printing mask put thereon, and several different printing patterns from many printing patterns stored beforehand, on the screen 23 of the display 22. The printing patterns represent objects, such as pictures and characters, to be printed on the nail surface. The computer displays a combined image formed by putting the selected printing pattern on the printing mask on the screen 23 of the display 22 in a predetermined position of the printing mask, for example, a position where the center of the printing mask coincides with the center of the printing pattern.

In case the printing pattern is not suitable, a printing pattern considered more suitable is selected by operating the input keys. This printing pattern so selected may be edited by enlarging, reducing, rotating and/or color changing the selected printing pattern. The printing pattern may be finalized by operating the operating buttons. Also, a combined printing pattern may be displayed on the screen by combining a printing pattern with another printing pattern. The printing masks described above may be formed by combining different printing masks. For example, a first printing pattern may be defined inside a selected mask, where a heart-shaped mask is put within the first printing pattern to clear an area corresponding to the heart shape from the first printing pattern for putting a second printing pattern within the area cleared by the heart-shaped mask. The combined images of printing masks and printing patterns, and the combined images of different printing masks, as described above, may be all editable similarly to the case of printing patterns described above. These functions are all controlled by the computer.

These printing masks, printing patterns, combined images of printing patterns and printing masks, and combined images of different printing masks, finalized as described above, may be stored in the computer either without attaching a password, or with a password attached by inputting the password by means of the input keys. The printing masks, printing patterns, and combined images are not retrievable without inputting the respective passwords.

The computer 4, shown in FIG. 6, while moving the nozzle unit 1 by driving the moving means 3 of the printer 29, shown in FIG. 6, causes color ink to jet from the nozzle unit 1 onto the nail surface 2, and thereby securely printing the finalized printing pattern on the nail surface 2, to draw the nail art picture. Also, the computer 4 may be capable of causing a preprinting processing solution to be discharged from the nozzle unit 1 onto the nail surface 2 to form a layer allowing ink dispersion, and, after drawing the nail art picture, causing a postprinting processing solution to be discharged from the nozzle unit 1 onto the nail surface 2 to form a layer protecting the print. Thus, when a layer allowing ink dispersion and a layer protecting the print are formed on the nail surface, before and after printing the nail art picture, respectively, the color ink jetted is fixed on the nail surface securely.

The printing on the nail surface is implemented within a printing area made corresponding to the nail shape by introducing printing masks, whereby the area peripheral to the nail is not likely to be stained.

Various external equipment, such as a card reader 32 for a digital still camera 31, an image scanner 33, a keyboard 6, and a disk drive 34 for a floppy disk 35, may be connected to interfaces 30 of the computer 4, thereby enabling to input data, such as hand-written designs, photographs, and characters, via such external equipment. The inputted data may be displayed on the screen 23 of the display 22 to be edited as printing patterns and stored. These functions are all controlled by the computer 4.

Moreover, data, such as hand-written designs, photographs, and nail art pictures printed on nail surfaces, may be picked up as images by a video movie camera 28 or a digital still camera 31, where these images may be displayed on the screen 23 of the display 22 to be edited as printing patterns and stored. Characters, such as letters and numerals, may be inputted as printing patterns, via the input keys in the form of text data. These functions are all controlled by the computer 4.

Furthermore, it may be arranged that not just a single fingertip but all a plurality of fingertips inserted from the insertion opening are displayed, as images, on the screen of the display, where identical or different printing patterns may be simultaneously printed on the plurality of fingertips by controlling the video movie camera, display and printer from the computer. In this case, the computer has a data correcting function for correcting data, such as the printing positions, and the longitudinal and lateral dimensions of the printing patterns, according to the conditions of these fingertips, thereby enabling to print the most suitable printing patterns for the respective nail surfaces.

Figure 12:
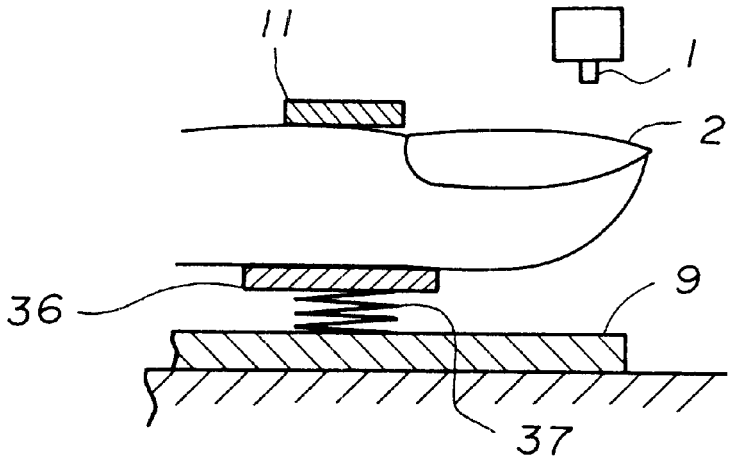
FIG. 12 is a sectional side view of a finger holder pressing a finger against a finger back stopper.

As shown in FIG. 12, the finger holder 9 may have a finger support 36, not equipped with a fingernail tip stopper, movably provided, where the finger support 36 is pressed by means of a spring 37 or an electric actuator, toward a finger back stopper 11 having a cross-section of a U or L shape. With this arrangement, the back of the finger 20 placed on the finger support 36 is pressed against the finger back stopper 11 fixed to the finger holder 9, thereby keeping the distance between the nozzle unit 1 and the nail surface 2 constant.

Figure 13:
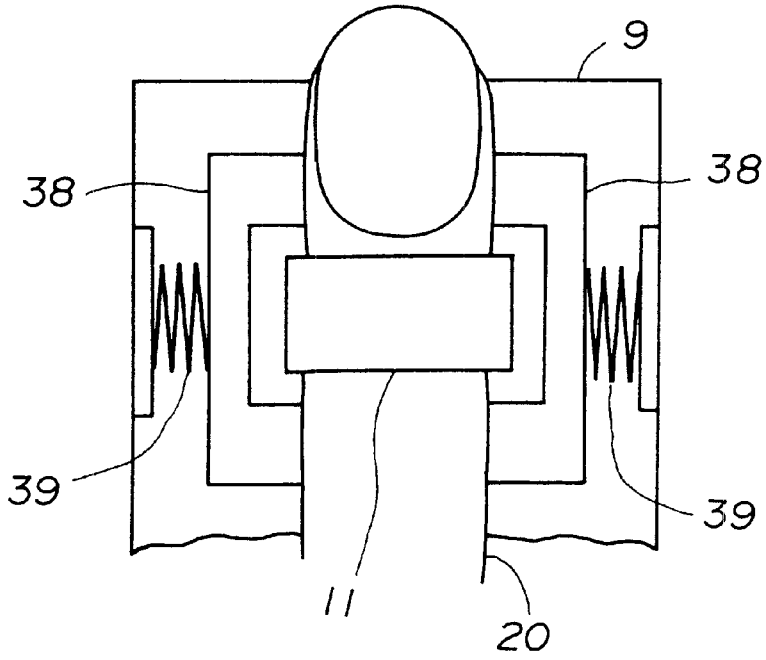
FIG. 13 is a plan view of a finger holder holding both sides of a finger.

As shown in FIG. 13, the finger holder 9 may have a finger side holder unit 38 movably provided, for holding the finger 20 from both the right and left sides thereof with legs thereof astride the finger back stopper 11, whereby the legs of the finger side holder unit 38 are pressed, by means of a spring 38 or an electric actuator, against the finger 20 held therebetween. By this, misalignment of the finger with the nozzle unit is prevented.

Figure 14:
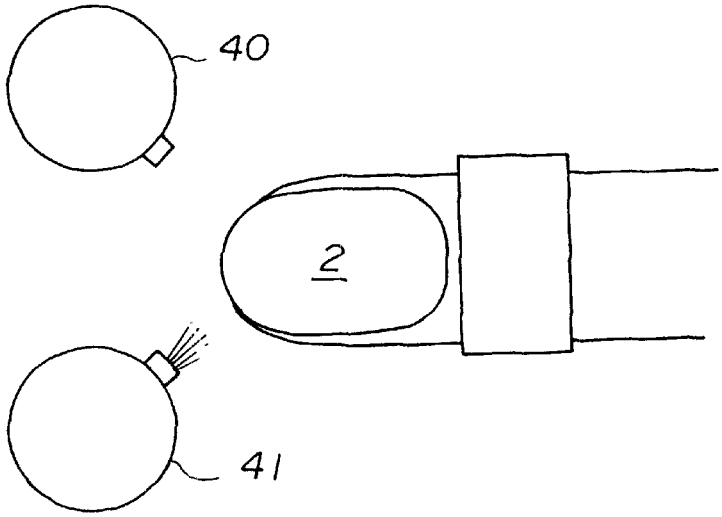
FIG. 14 is a schematic view showing jetting means for preprinting processing solution and postprinting processing solution.
Figure 15:
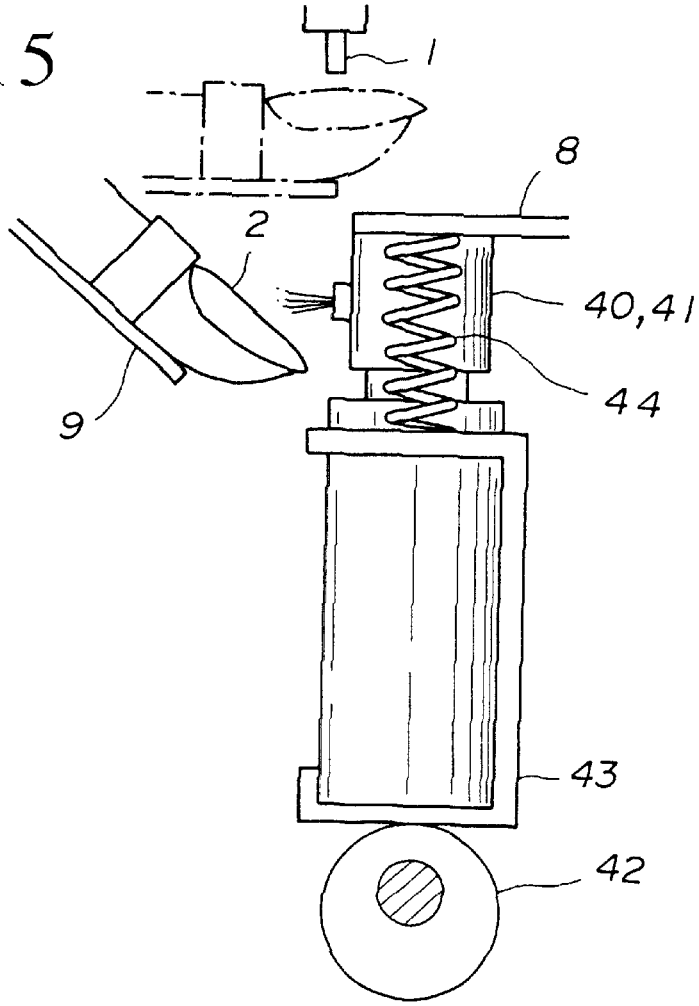
FIG. 15 is a schematic side view showing a driving mechanism for the jetting means.

As shown in FIG. 14, a spray 40 for jetting a preprinting processing solution and a spray 41 for jetting a postprinting processing solution, onto the nail surface 2, instead of the nozzle unit, may be provided. In this case, as shown in FIG. 15, the finger holder 9 may be provided swingably relative to the nozzle unit 1. When the finger holder 9 swings, the nail surface 2 faces the sprays 40 and 41, while the nail surface 2 faces the nozzle unit 1 when returns to the original position, as shown in chain lines. The sprays 40 and 41 are of a telescopic type, with the stationary side thereof attached to a portion of the frame 8. The respective moving sides of the sprays 40 and 41 are attached to the respective movable frames 43 thereof, with their respective compression springs 44 placed between the portion of the frame 8 and the movable frames 43. The movable frames 43 each respectively conduct a reciprocating motion by rotation of their respective cams 42 each containing a one-way clutch. Not shown, each cam is applied with rotational drive by a common, forward-reverse turning motor. The cam-rotating motor may be either controlled by a computer that operates the printing, or controlled directly with operating buttons separate from that computer.

What is claimed is:

1. A method of providing nail art CHARACTERIZED IN THAT said method comprises the steps of:

holding one ore more nail surfaces (2) on a finger holder (9);

selecting one ore more printing patterns from printing patterns stored in control means (4);

moving either one or both of printing means (1) and said finger holder by means of moving means (3) controlled by said control means; and concurrently with said moving step, printing said selected printing pattern on said nail surface, by causing said printing means to perform said printing.

2. A method of providing nail art according to claim 1, CHARACTERIZED IN THAT:

said control means has display means (22) connected thereto, for displaying said stored printing patterns on the screen (23) of said display means; and said selecting step includes selecting said one ore more printing pattern from said displayed printing patterns.

3. A method of providing nail art according to claim 1, CHARACTERIZED IN THAT:

said control means is connected to data input means (28, 31, 32, 33, 34, 35), said data input means inputting therethrough and storing in said control means either one or both of said printing patterns and printing masks for limiting the printing areas of said printing patterns.

4. A method of providing nail art according to claim 3, CHARACTERIZED IN THAT:

both of said printing patterns and said printing masks for limiting said printing areas of said printing patterns, are displayed on said screen of said display means, separately, or with said printing masks put on said printing patterns, and edited to be stored.

5. A method of providing nail art according to claim 4, CHARACTERIZED IN THAT:

a nail image inputted by image pickup means (28, 31) of said data input means, is displayed on said screen of said display means, and a printing mask, a printing pattern, or a printing pattern with a printing mask put thereon, is put on the nail surface portion of said nail image displayed on said screen to be displayed together on said screen.

6. A method of providing nail art according to claim 1, CHARACTERIZED IN THAT:

said printing means applies either one or both of a preprinting processing solution and a postprinting processing solution onto said nail surface.

7. A method of providing nail art according to claim 1, CHARACTERIZED IN THAT:

jetting means, independent of said printing means, applies either one or both of a preprinting processing solution and a postprinting processing solution onto said nail surface.

8. A method of providing nail art according to claim 1, CHARACTERIZED IN THAT:

said nail surface is the nail surface of a human finger tip.

9. A method of providing nail art according to claim 1, CHARACTERIZED IN THAT:

said nail surface is the nail surface of an artificial fingernail.

10. An apparatus for providing nail art CHARACTERIZED IN THAT said apparatus comprises:

a finger holder (9) capable of holding a nail surface (2);

control means (4) capable of storing printing patterns therein, and selecting one ore more printing pattern from said stored printing patterns;

printing means (1), under the control of said control means, for printing said selected printing pattern on said nail surface; and moving means (3), under the control of said control means, for moving either one or both of said printing means and said finger holder;

said control means causing said moving means to move said finger holder and said printing means relative to each other so that said selected printing pattern is printed on said nail surface.

11. An apparatus for providing nail art according to claim 10, CHARACTERIZED IN THAT:

said control means has one or more data input means (28, 31, 32, 33, 34, 35) connected thereto, said data input means being capable of inputting and storing said printing patterns and printing masks for limiting the printing areas of said printing patterns, in said control means.

12. An apparatus for providing nail art according to claim 10, CHARACTERIZED IN THAT:

display means (22) is connected to said control means, said display means being capable of displaying and editing on the screen thereof said printing patterns and said printing masks inputted and stored in said control means, said display means being capable of causing said control means to store said edited printing patterns.

13. An apparatus for providing nail art according to claim 12, CHARACTERIZED IN THAT:

said data input means is an image pickup means (28, 31) capable of inputting a nail image.

14. An apparatus for providing nail art according to claim 13, CHARACTERIZED IN THAT:

said display means is capable of displaying a printing pattern formed by putting a printing mask on the nail surface portion of said nail image.

15. An apparatus for providing nail art according to claim 10, CHARACTERIZED IN THAT:

said printing means is capable of discharging either one or both of a preprinting processing solution and a postprinting processing solution on said nail surface.

16. An apparatus for providing nail art according to claim 10, CHARACTERIZED IN THAT:

jetting means (40, 41), independent of said printing means, is provided for jetting either one or both of a preprinting processing solution and a postprinting processing solution on said nail surface.

17. An apparatus for providing nail art according to claim 10, CHARACTERIZED IN THAT:

said finger holder has a finger support (36) movably provided with by means of a spring (37) or an actuator so that said finger holder holds a finger (20) resting on said finger support, against a finger back stopper (11).

18. An apparatus for providing nail art according to claim 17, CHARACTERIZED IN THAT:

said finger holder has a finger side holder unit (38) for holding said finger (20) from both sides thereof, movably provided with by means of springs (39) or an actuator.

19. An apparatus for providing nail art according to claim 10, CHARACTERIZED IN THAT:

said nail surface is the nail surface of a human finger tip.

20. An apparatus for providing nail art according to claim 10, CHARACTERIZED IN THAT:

said nail surface is the nail surface of an artificial fingernail.

* * * * *